United States Patent [19]

Frazier

[11] Patent Number: 5,039,467

[45] Date of Patent: Aug. 13, 1991

[54] PROCESS FOR PRODUCING ZERO PILLING POLYESTER

[75] Inventor: Debbie E. Frazier, Charlotte, N.C.

[73] Assignee: Hoechst Celanese Corporation, Somerville, N.J.

[21] Appl. No.: 385,136

[22] Filed: Jul. 25, 1989

[51] Int. Cl.[5] ..... D01F 11/04

[52] U.S. Cl. ..... 264/184; 264/211.15; 264/211.16; 264/232; 264/340

[58] Field of Search ..... 264/211, 211.16, 211.15, 264/184, 232, 340

[56] References Cited

U.S. PATENT DOCUMENTS 4,621,020 11/1986 Tashiro et al. ..... 428/401

*Primary Examiner*—Hubert C. Lorin

*Attorney, Agent, or Firm*—Robert H. Hammer, III

[57] ABSTRACT

A process for producing zero pilling polyester filaments, staple, yarn and fabrics is disclosed. The process steps include: providing a polyester polymer containing a structure opener and a monomer containing a sulfonate group; forming the polymer into fibers; hydrolyzing those fabrics; and arresting the hydrolysis by the addition of a metal ion source.

31 Claims, No Drawings

PROCESS FOR PRODUCING ZERO PILLING POLYESTER

FIELD OF THE INVENTION

Polyester fibers, which may be converted into yarns, fabrics or garments, are hydrolyzed so that the resulting fabrics and garments will not pill.

BACKGROUND OF THE INVENTION

It is generally recognized that the fabrics comprising synthetic polymer fibers, such as polyethylene terephthalate (PET) fibers, and blends of natural and synthetic fibers have an undesirable propensity upon prolonged use to exhibit small, compact groupings of entangled fibers (i.e., fuzzballs) on the fabric surface. Such fiber groupings commonly are termed "pills" and tend to form and to tenaciously adhere to the surface of the fabric as the fabric encounters surface abrasion during normal use. The aesthetic appearance of fabric accordingly may be adversely influenced by these relatively compact groupings of entangled fibers which are retained on the surface of the fabrics.

Heretofore, it has been believed that such pills can be traced to the relatively high strength of the synthetic fibers present in the fabric. For instance, the pills may be more or less permanently attached to the fabric surface by one or a few synthetic polymer fibers extending out of the fabric which will resist breakage as surface abrasion continues. This theory of pill formation is supported by the lower level of the retention of undesired fuzzballs on the surface of the fabrics consisting solely of cotton fibers following the same surface abrasion conditions. It is believed, for instance, that any entangled cotton fibers which form at the surface of the fabric readily break away since the cotton fibers are of an inherently lesser strength.

This pilling problem may be observed in fabrics formed in whole or in part from polyethylene terephthalate fibers which are either in a staple or in a continuous configuration. Pills commonly are observed on the fabric formed from blends of cotton and staple polyethylene terephthalate fibers following extended use. While the pills may be observed in fabrics having a wide variety of constructions, they are frequently observed on loosely constructed fabrics, particularly knitted fabrics which comprise polyethylene terephthalate fibers.

One approach heretofore proposed to reduce the tenacity of the polyethylene terephthalate fibers to pill initially to limit the molecular weight (measured as the intrinsic viscosity) of the polyethylene terephthalate polymer prior to fiber formation. Such reduced intrinsic viscosity provides a general indication of reduced polymeric chain length and leads to fibers having a lesser strength. Accordingly, when such entangled fibers become free on the surface of the fabric following abrasion, they tend to cleanly break away more readily and do not serve as a secure link which retains a fuzzball at the surface of the fabric. It has been found, however, that when this approach is followed, it is more difficult initially to form and process the polyethylene terephthalate into a fabric using standard processing conditions because of their reduced strength. Such reduced strength can lead to premature fiber breakage and to concomitant processing disadvantages.

In U.S. Pat. Nos. 3,104,450; 3,576,773; 3,580,874; 3,607,804; 3,991,035; and 4,004,878, the incorporation of certain moieties in the backbone of the polyethylene terephthalate fibers, to reduce the fibers' strength, is proposed in an effort to improve the pilling characteristics.

Another approach is to weaken the polyester fibers after forming. In U.S. Pat. Nos. 3,834,868, 4,270,913 and 4,666,454 the degradation of previously formed polyethylene terephthalate fibers is proposed in an effort to reduce the propensity of the fiber to pill.

U.S. Pat. No. 4,666,454 discloses a fabric containing a polyethylene terephthalate fibers having a reduced tendency to pill. The disclosed PET fibers include 5 to 15% by weight of monomer polyethylene glycol (PEG) with an average molecular weight of 200 to 2000. Other moieties, e.g. diacids such as isophthalic acid, adipic acid and sulfoisophthalic acid, may be added at the rate of 1 to 10% by weight of monomer, but only so long as those moieties "do not interfere" with the fabric's ability to have a reduced tendency to pill. The disclosed PET fibers are subsequently treated in a dye bath in which the fabric is both colored and the intrinsic viscosity of the PET fibers is reduced. The dye bath conditions are as follows: a pH of 3 to 5; temperature of 90° to 160° C. ; residence time of 10 to 90 minutes. The reduced tendency to pill is made possible by the presence of degradation susceptible units derived from polyethylene glycol. The resulting fabric when subjected to prolonged surface abrasion exhibits no substantial tendency to pill.

In the fabric dying arts, it is known that cationic dyeable fabrics will weaken when subjected to the dye bath. Moreover, it is known that such weakening will be arrested by the addition of salts, i.e. Glauber's salts, to the dye bath. Yet, no one has ever proposed that the pilling properties of fabric may be controlled by arresting the weakening of a fabric by the addition of a salt.

These prior solutions, however, have not led to commercially attractive processes. This failure is due to the fact that it is difficult to implement those processes. For example, the former approach, weakening the polymer before processing, causes the fibers to break prematurely, while the latter approaches are difficult to control.

SUMMARY OF THE INVENTION

A process for producing zero pilling polyester filament, staple, yarn and fabric comprising the steps of;

providing a polyester polymer containing a structure opener and a monomer containing a sulfonate group;

forming said polymer into fibers;

hydrolyzing said fibers; and arresting said hydrolysis by addition of a metal ion source.

The instant process for rendering polyester filament, yarn, fabric or garments zero pilling is intended for use prior to or simultaneously with dying. Accordingly, the process must be easily controlled.

As noted above, prior attempts at producing zero pilling polyester were difficult or expensive to commercialize because the polyester must be weakened before processing or if weakened after processing the method of weakening is difficult to control.

The instant process overcomes the disadvantages of the prior art because of its simplicity and ease of control. The process is simple and easy to control because the operator need only monitor time, temperature and pH (which can be controlled by the volumetric addition of acid).

Accordingly, the instant process fulfills a need for a process to render polyester zero pilling which is simple to use, easy to control and readily commercializable.

DETAILED DESCRIPTION OF THE INVENTION

The instant invention is directed to a process for treating a specific polyester polymer formulation so that the resulting polyester fabric does not pill.

The process generally comprises the steps of:

providing a specific polyester polymer formulation containing a structure opening unit and a monomer containing sulfonate group;

forming said polymer into fibers;

hydrolyzing said fibers; and arresting said hydrolysis by the addition of a metal ion source.

The fabrics made according to the process do not pill, i.e. they are zero pilling fabrics. The term "zero pill" or its equivalent means herein that the tested material obtains a value of 4–5 as defined by ASTM D3512-82 entitled "Standard Test Method for Pilling Resistance and Other Related Surface Changes of Textile Fabrics: Random Tumble Pilling Tester Method". The value of 5 indicates no pill formation, whereas values between 0 and 4 indicate various levels of pilling.

The instant process is believed to operate according to the following theory, however, this theory does not limit the invention:

Acid, i.e. the H+ion, can catalyze the hydrolysis of the polymer chain thereby decreasing the polymer's molecular weight and consequently the polymer's intrinsic viscosity. Thus, the problem is to get sufficient H+ions into sufficient sites within the polymer, which is in the form of a fiber or a bundle of fibers, so that the intrinsic viscosity can be reduced to the zero pilling range.

The polymer is formulated with "structure openers" and "monomers containing sulfonate groups". The structure openers are monomers which are copolymerized in the polymer and act as pathways so that migration of ions into and out of the polymer is facilitated. The "monomer containing sulfonate groups" are also copolymerized into the polymer and are used to attract the H+ion to the polymer.

When the polymer is placed into the acidic bath for hydrolysis, the H+ion and $H_2O$ migrate into the polymer via the structure openers to the monomer containing the sulfonate group. There the H+ion catalyzes the polymer hydrolysis and the intrinsic viscosity of the polymer is reduced.

At the appropriate time (the appropriate time being a function of polymer formulation, bath pH and temperature), a source of metal ions may be added to the bath to arrest the hydrolysis. The metal ions exchange place with the H+ions in the polymer.

Hereinafter, the process will be discussed in detail.

The instant process is principally intended for use by those fabric processors that have pressure dyeing processes, as the process requires equipment which can withstand temperatures above 100° C. and autogenous pressures created by heating aqueous baths above 100° C.

The following PET polymer can be made by either the terephthalic acid (TA) or dimethyl terephthalate (DMT) processes, both of which are well known to those of ordinary skill in the art. The intrinsic viscosity of the polyester polymer is not controlled to any particular level for the purpose of the instant invention, but it is controlled so that the resulting fibers will have the necessary strength to be converted or processed into fabric and garments. Typically, however, the intrinsic viscosity will be in the range of about 0.55 to 0.62.

The polymer preferably contains about 0.16 to 3.3 mole percent based on terephthalic acid (TA) or dimethyl terephthalate (DMT) of a monomer containing a sulfonate group. Exemplary monomers containing a sulfonate group may be those selected from the group consisting of sodium 5-sulfo-isophthalic acid (SIPA), bis (1,2-dihydroxy ethyl)-5-sulfo-isophthalate ester, sodium dimethyl 5-sulfo-isophthalate (SIM) and isomers of these compounds or other sulfonate containing moities. SIPA is preferred.

The lower limit of 0.16 mole percent represents the minimum amount of monomer need so that reasonable hydrolysis times may be obtained. The upper limit of 3.3 mole percent represents a practical limitation. Amounts of monomer above this level cause the polymer to become very viscous and difficult to process in existing equipment. A preferred monomer range is 0.33 to 0.67 mole percent.

A reduction of the mole percent of sulfonate containing monomer causes hydrolysis time and temperatures to increase. Accordingly, the sulfonate containing monomer content of the polymer may be adjusted so that hydrolysis conditions may be modified to suit equipment/process parameters of the bath.

The polymer also contains at least 2 mole weight percent based on TA or DMT of a structure opener. Exemplary structure openers may be selected from the group consisting of diethylene glycol (DEG), adipate, polyethylene glycol (PEG), propane diol, 2,2-diethyl-1,3-propane diol, butane diol, triethylene glycol, adipic acid, glutaric acid, and isophthalic acid (and the dimethyl esters of the acids). Combinations thereof may also be used. An upper limit of the structure opener is about 5 mole percent. The upper limit is defined, in part, by practical considerations, namely addition of structure openers adversely affects the physical properties of the fiber, i.e. shrinkage and strength. Moreover, greater amounts of the structure opener, that is amounts over 5 mole percent, do not significantly improve the hydrolysis conditions. The lower limit of 2 mole percent represents the minimum amount of structure opener needed so that reasonable hydrolysis times may be obtained. Depending upon the polymerization process and the starting materials, structure openers may not have to be added separately, but instead they may occur naturally in the polymerization process.

The polyester polymer based on the formulations discussed above are spun into fibers as is well known in the art. These fibers may be cut into staple length or utilized in their continuous filament form. The staple or filaments can then be spun into yarns which are subsequently converted into fabrics and then on to garments. The staple or filament may also be blended with other materials, e.g. cotton, in a known manner.

After the fibers have been formed into a yarn, fabrics, or garments, but before they are dyed, they are subjected to the hydrolysis and arrest steps to reduce the polymer's intrinsic viscosity to a level so that it will not pill.

The hydrolysis reduces the intrinsic viscosity of the polyester polymer. Intrinsic viscosity is a surrogate measurement indicative of the chain length of the polymer and therefore the strength of the polymer.

The conditions for the hydrolysis are as follows: the pH of the aqueous bath ranges from 4.5 to 2.0; the bath temperature ranges from 100°-150° C.; the hydrolysis time ranges from 5 to 120 minutes. The intrinsic viscosity after hydrolysis is in the range of about 0.32-0.40. Optimally, the range is about 0.36-0.39.

The pH of the aqueous bath is preferably controlled by the addition of an organic acid such as acetic acid or formic acid. Other organic acids which may be used include sulfobenzoic acid, sulfosalicylic acid, phenol sulfonic acid, sulfanilic acid, aminobenzoic acid, terephthalic acid, and anthranilic acid. Combinations of these organic acids may also be used. Hydrolysis can also be successfully accomplished using inorganic acids such as sulfuric acid, phosphoric acid and hydrochloric acid, but lower pH baths are required.

The pH ranges from 4.5 to 2.0, with a bath pH of approximately 3 being preferred. The use of acetic acid is preferred because the bath pH is easily controlled by volumetric addition of acetic acid thereby eliminating the necessity of pH meters which can be inherently inaccurate. The pH of 4.5 apparently represents an upper limit to the instant process, in that pH's above this level provide insufficient concentration of hydrogen ions to hydrolyze the polymer.

The temperature of the bath should range from 100°-150° C. The 150° upper limit is defined not because of reaction kinetics, but because of the equipment limitations. Therefore, temperatures above 150°C. could be utilized, if appropriate equipment is available. At temperatures below 100° C., the hydrolysis time is too long for a commercially viable process.

The time of the hydrolysis may range from 5-120 minutes. Longer times may be used, but they may be economically less attractive. The time is the free variable and the one measured to control the process.

As will be readily apparent to those of ordinary skill in the art, the precise pH, temperature and time periods for the hydrolysis are all interdependent and will vary with the composition of the polyester polymers. The ultimate intrinsic viscosity of the polymer is controlled by tailoring the component mixture of the polymer and thereafter matching that formulation with the specific pH, time and temperature requirements of the process treatment.

Generally, the hydrolysis is stopped by the addition of a source of metal ions. Arresting the hydrolysis may be accomplished by raising the bath pH with a base or by adding a salt. Since the bath is at a temperature of 100° C. or more and under autogenous pressure, addition of the metal ion source may be facilitated by lowering the bath temperature, for example to about 82° C.

When hydrolysis is arrested by raising the bath pH, a base such as sodium hydroxide or sodium carbonate may be used. The pH of the bath is raised to about 4.5. Sodium hydroxide is preferred.

When hydrolysis is arrested by adding a salt, the pH may remain substantially unchanged, and arrest is determined by the amount of salt added. Salts such as Glauber's salt (sodium sulfate decahydrate) or the sulfate salt of cesium, potassium, ammonium, sodium and lithium may be used. The salt may also be present in the dyestuff. Glauber's salt arrests hydrolysis when added to the bath within the range of about 0.5-5% by weight of fiber. When the other salts are used, they are added at a mole percent which is equivalent to the weight percent of Glauber's salt.

As mentioned above the hydrolysis and arrest steps are preferably performed before fabric dying, however, hydrolysis and arrest may be performed simultaneously with fabric dying.

Considering the former, fabric is placed into a bath. The bath is brought to hydrolysis conditions, then the hydrolysis is arrested. Then, without removing the fabric from the bath, the dyes are added to the bath in a conventional manner.

Considering the latter, fabric is placed into a bath. Hydrolysis and arrest are performed as discussed above, but the dyestuff are added at the beginning of the hydrolysis.

The following Examples illustrate specific embodiments of the invention, but the invention is not limited to such Examples. The intrinsic viscosity values have a standard deviation of ±0.009.

EXAMPLE 1

Polyethylene terephthalate (PET) polymer is made via DMT batch polymerization process. The dimethyl ester of sodium 5-sulfoisophthalic acid is added at 0.67 mole % on DMT. Diethylene glycol (DEG) is added and incorporated to yield a polymer containing 5 mole DEG. The intrinsic viscosity of the resulting polymer is 0.55. The polymer is processed into staple fiber, yarn and fabric.

The hydrolysis step entails holding the fabric at 130 degrees centigrade for 45 minutes in a bath acidified to pH 3 with acetic acid. The hydrolysis is arrested by cooling to 82 degrees centigrade and addition of sodium hydroxide to raise the bath pH to 4.5. The intrinsic viscosity of the fiber drops from 0.55 to 0.38 during the hydrolysis step. Dyestuff and auxiliaries are then added and fabric dyeing proceeds.

Pre-treatment of the fabric with a hydrolysis step, followed by conventional atmospheric or pressure dyeing results in a fabric with a random tumble pill rating of 5 (5=zero pills).

EXAMPLE 2

Polyethylene terephthalate polymer is made via a terephthalate acid (TA) continuous process. The Bis (1,2-hydroxy ethyl)-5-sulfoisophthalate ester is added at 2 mole percent on TA. The natural level of DEG generated in this process is 5 mole percent so addition to the polymer recipe is not required.

The hydrolysis step entails holding the fabric at 110 degrees centigrade for 25 minutes in a bath acidified to pH 3 with acetic acid. The hydrolysis is arrested by cooling to 82 degrees centigrade and addition of sodium hydroxide to raise the bath pH to 4.5. The intrinsic viscosity of the fiber drops from 0.55 to 0.38 during the hydrolysis step. Dyestuff and auxiliaries are then added and fabric dyeing proceeds.

Pre-treatment of the fabric with a hydrolysis step, followed by conventional atmospheric or pressure dyeing results in a fabric with a random tumble pill rating of 5 (5=zero pills).

EXAMPLE 3

Treatment of the spun yarn from example 2 (prior to fabric formation) can be accomplished in a two step hydrolysis-package dyeing operation. The spun yarn formed on a package is hydrolyzed for 30 minutes at 110 degrees centigrade in a bath acidified to pH 3 with acetic acid. The fiber I.V. drops from 0.55 to 0.39 during this treatment. The bath is cooled to 82 degrees centigrade and the pH raised to 4.5 by the addition of a sodium hydroxide solution. Dyes and auxiliaries are added and the dyeing operation completed. The resulting yarn drops single-end tenacity from 2.0 grams per denier to 1.3. The elongation at break drops from 19% to 15% with skein-break factor changing from 2670 to 1570. Overall physical yarn properties have dropped but still allow the yarns to be successfully processed into fabrics.

EXAMPLE 4

The hydrolysis conditions of fabrics from Example 1 can be varied with respect to time and temperature of the acidified bath. Table A lists the conditions required to reach the targeted I.V. range of 0.38.

TABLE A

| pH | Degrees Centigrade | Time in Minutes |
|---|---|---|
| 3 | 120 | >60 |
| 3 | 130 | 45 |
| 3 | 140 | 20 |

EXAMPLE 5

Lowering the amount of dimethyl 5-sulfo-isophthalate in the PET from example 1 to 0.33 mole % on DMT creates a polymer which requires higher temperatures during the hydrolysis step. Sixty minutes at 140 degrees centigrade in a pH 3 bath (acidified with acetic acid) are necessary to produce a fabric with random pilling values of 5. The level of dimethyl-5-sulfo-isophthalate in the polymer can be adjusted to satisfy the time and temperature constraints of available equipment/-process.

EXAMPLE 7

Manipulation of the hydrolysis step variables of time, temperature, and pH allows for production of fabrics with random tumble pilling values of 5. Fabrics made from the polymer in Example 2 reach the targeted intrinsic viscosity of 0.38 under the following conditions:

| pH | Degrees Centigrade | Time in Minutes |
|---|---|---|
| 3 | 110 | 35 |
| 3 | 120 | 25 |
| 3 | 130 | 10 |
| 3 | 130 | 10 |
| 3.5 | 130 | 15 |
| 4 | 130 | 25 |
| 4 | 130 | 20 |

-continued

| pH | Degrees Centigrade | Time in Minutes |
|---|---|---|
| 4 | 140 | 8 |

EXAMPLE 7

In Examples 1 and 2 the fiber hydrolysis was arrested by raising the bath pH to 4.5 with a sodium hydroxide solution. Raising the pH with other bases would also arrest the hydrolysis. In addition, Glauber's salt and other sulfate salts arrest the hydrolysis (even when the pH remains constant at 3). As the concentration of the sulfate salts of cesium, potassium, ammonium, sodium and lithium are increased in the bath, the amount of fiber hydrolysis decreases.

EXAMPLE 8

The hydrolysis step and fabric dyeing may be combined under special conditions for a one-step process. This is possible at dye concentrations of 1 percent on weight of fiber. The lignin sulfonate (and other residual salts) in the dyestuff inhibit the loss of fiber intrinsic viscosity at 5 percent on weight of fiber of the dyestuff. Dyes which do not contain lignin sulfonate or other salts would readily allow the combination of the hydrolysis step and dyeing for a shorter process.

Effect of Dye Concentration on Fabric Filling

| Dye | 1% OWF Pill Rating 10, 20, 30, 60 | 5% OWF Pill Rating 10, 20, 30, 60 |
|---|---|---|
| Red 60 | 4, 4, 5, 5 | 1, 1, 1.5, 1 |
| Yellow 42 | 5, 5, 5, 5, | 2.5, 2.5, 5, 5 |
| Blue 27 | 1.5, 2.5, 5, 5 | 1, 1, 1, 1 |
| Blue 56 | 4, 4, 5, 5 | 1, 1, 1, 1 |

Conditions: pH 3, 120° C., 30 minutes, dye.
Note:
Fabrics hydrolyzed under these conditions without dye consistently produce Zero Pill fabrics.

EXAMPLES 9–15

Examples 9–14 further illustrate the instant invention. Example 15 is a comparative example in which the polymer has no monomer containing a sulfonate group.

In all the remaining examples the polymer was produced by a DMT polymerization process with the exception of Example 10 which was produced by the TA process.

In Examples 11–13, additional structure opener (DEG) was added to increase the mode percent thereof. In Examples 14–15, additional structure opener (adipate) was added.

| MOLE % SIPA & MOLE % STRUCTURE OPENER | TIME (m), TEMP (°C.), pH OR VOLUME (ACID) | ARREST | INITIAL I.V. | FINAL I.V. |
|---|---|---|---|---|
| EXAMPLE 9 | | | | |
| 1.8 MOLE % SIPA 2.0 MOLE % DEG | 85, 130 pH 3 (FORMIC) | | 0.588 | 0.386 |
| EXAMPLE 10 | | | | |
| 2 MOLE % SIPA 5 MOLE % DEG | 25, 120, 3.4 m/L (ACETIC) | 10% NaOH, pH to 5 | 0.56 | 0.323 |
| | | 5% OWF Na2SO4 | 0.56 | 0.239 |
| | | NO ARREST | 0.56 | 0.239 |
| | 25, 120, 3.2 mL/L (ACETIC) | | | 0.338 |
| | 25, 120, 3.4 mL/L (ACETIC) | | | 0.335 |

-continued

| MOLE % SIPA & MOLE % STRUCTURE OPENER | TIME (m), TEMP (°C.), pH OR VOLUME (ACID) | ARREST | INITIAL I.V. | FINAL I.V. |
|---|---|---|---|---|
| | 25, 120, 3.8 mL/L (ACETIC) | | | 0.331 |
| | 25, 120 pH 3.2 (ACETIC) | | | 0.386 |
| | 25, 120 pH 3.0 (ACETIC) | | | 0.359 |
| | 25, 120 pH 2.8 (ACETIC) | | | 0.305 |
| | 25, 130, pH 3 (FORMIC) | | | 0.317 |
| | 30, 120, pH 4.5 (TA) | | | 0.285 |
| | 45, 100, pH 3 (ACETIC AND 5% OWF SULFO SALICYLIC ACID) | | | 0.373 |
| | 45, 100, pH 3 (ACETIC AND 5% OWF SULFO BENZOIC ACID) | | | 0.387 |
| | 45, 100, pH 3 (ACETIC AND 5% OWF PHENOL SULFONIC ACID) | | | 0.391 |
| EXAMPLE 11 | | | | |
| 1 MOLE % SIPA | 20, 140, pH 3 (ACETIC) | | 0.56 | 0.38 |
| 5.5 MOLE % DEG | 40, 130, pH 3 (ACETIC) | 10% NaOH, pH to 5 | | 0.361 |
| EXAMPLE 12 | | | | |
| 0.67 MOLE % SIPA 5.5 MOLE % DEG | 45, 130, pH 3 (ACETIC) | 10% NaOH, pH to 5 | 0.57 | 0.38 |
| | | 5% OWF Na2SO4 | | 0.355 |
| | | NO ARREST | | 0.317 |
| EXAMPLE 13 | | | | |
| 0.5 MOLE % SIPA 5.5 MOLE % DEG | 50, 140, pH 3 (ACETIC) | | 0.58 | 0.387 |
| EXAMPLE 14 | | | | |
| 0.67 MOLE % SIPA 2 MOLE % DEG 0.12 MOLE % ADIPATE | 45, 130, pH 3 (ACETIC) | | 0.551 | 0.348 |
| EXAMPLE 15 | | | | |
| 0% SIPA 2 MOLE % DEG 0.12 MOLE % ADIPATE | 45, 130, pH 3 (ACETIC) | | 0.532 | 0.520 |

That which is claimed is:

1. A process for producing zero pilling polyester filament, staple, yarn, and fabric comprising the steps of:

providing a polyester polymer containing a structure opener and a monomer containing a sulfonate group;

forming said polymer into fibers;

hydrolyzing said fibers until the polyester polymer's intrinsic viscosity reaches a zero pilling polyester range by providing an aqueous bath having a pH ranging from about 4.5 to about 2.0; and arresting said hydrolysis by addition of a metal ion source.

2. A process for converting polyester containing yarns, fabrics, and garments to zero pilling polyester containing yarns, fabrics, and garments comprising the steps of:

providing a yarn, fabric, or garment comprising a polyester fiber containing a polyester polymer containing a structure opener and a monomer containing a sulfonate group;

hydrolyzing said yarn, fabric, or garment until the polyester polymer's intrinsic viscosity reaches the zero pilling polyester range by providing an aqueous bath having a pH ranging from about 4.5 to about 2.0; and arresting said hydrolysis by the addition of a metal ion source.

3. The process according to claims 1 or 2 wherein said polymer is polyethylene terephthalate polymer.

4. The process according to claims 1 or 2 wherein said structure opener comprises at least about 2 mole percent of said polymer.

5. The process according to claims 1 or 2 wherein said structure opener comprises between about 2–5 mole percent of said polymer.

6. The process according to claims 1 or 2 wherein said structure opener is selected from the group consisting of a diethylene glycol, polyethylene glycol, propane diol, 2,2-diethyl-1,3-propane diol, butane diol, triethylene glycol, adipic acid, glutaric acid, isophthalic acid, the dimethyl esters of the acids and combinations thereof.

7. The process according to claims 1 or 2 wherein said structure opener is diethylene glycol.

8. The process according to claims 1 or 2 wherein said monomer containing a sulfonate group comprises between about 0.16–3.3 mole percent of said polymer.

9. The process according to claims 1 or 2 wherein said monomer containing a sulfonate group comprises between about 0.33–0.67 mole percent of said polymer.

10. The process according to claims 1 or 2 wherein said monomer containing a sulfonate group is selected from the group consisting of sodium 5-sulfo-isophthalic acid, bis (1,2-dihydroxy ethyl)-5-sulfo-isophthalic ester, sodium dimethyl 5-sulfo-isophthalate.

11. The process according to claims 1 or 26 wherein said monomer containing a sulfonate group is sodium 5-sulfo-isophthalic acid.

12. The process according to claims 1 or 2 wherein said hydrolyzing further comprises providing an aqueous bath having a pH of about 3.

13. The process according to claims 1 or 2 wherein said hydrolyzing further comprises providing an acid.

14. The process according to claims 1 or 2 wherein said hydrolyzing further comprises providing an organic acid.

15. The process according to claim 14 wherein said organic acid is selected from the group consisting of acetic acid, formic acid, sulfobenzoic acid, sulfosalicylic acid, phenol sulfonic acid, sulfanilic acid, aminobenzoic acid, anthranilic acid and combinations thereof.

16. The process according to claims 1 or 2 wherein said hydrolyzing further comprises providing acetic acid.

17. The process according to claims 1 or 2 wherein said hydrolyzing further comprises providing an inorganic acid.

18. The process according to claim 17 wherein said inorganic acid is selected from the group consisting of sulfuric acid, phosphoric acid and hydrochloric acid.

19. The process according to claims 1 or 2 wherein said hydrolysis is conducted at temperatures ranging from about 100° C. and 150° C.

20. The process according to claims 1 or 2 wherein said hydrolysis is conducted for a period of time ranging from about 5 to 120 minutes.

21. The process according to claims 1 or 2 wherein said arresting comprises adding a base thereby raising the pH above 4.5

22. The process according to claim 21 wherein said base is selected from the group consisting of sodium hydroxide and sodium carbonate.

23. The process according to claims 1 or 2 wherein arresting comprises adding a salt at 0.5-5% by weight polymer.

24. The process according to claim 23 wherein said salt is selected from the group consisting of Glauber's salt or the sulfate salts of cesium potassium, ammonium, sodium and lithium.

25. The process according to claim 23 wherein said salt is Glauber's salt.

26. A process for converting polyester containing yarns, fabrics, and garments to zero pilling polyester containing yarns, fabrics, and garments comprising the steps of:

providing a yarn, fabric, or garment comprising a polyester fiber including a polyester polymer containing a structure opener and a monomer containing a sulfonate group;

hydrolyzing said yarn, fabric, or garment in an aqueous bath having a pH ranging from about 4.5 to about 2.0 and having a temperature ranging from about 100° C. to about 150° C. for about 5 to about 120 minutes until the polyester polymer's intrinsic viscosity reaches a zero pilling polyester range; and arresting said hydrolysis by addition of a metal ion source said metal ion source being selected from the group consisting of a base a salt, or a combination thereof.

27. The process for converting polyester containing yarns, fabrics, and garments to a zero pilling polyester containing yarns, fabrics, and garments comprising the steps of:

providing a yarn, fabric, or garment comprising a polyester fiber, including a polyester polymer containing a structure opener and a monomer including a sulfonate group;

hydrolyzing said yarn, fabric, or garment until the polyester polymer's intrinsic viscosity reaches a zero pilling polyester range by providing an aqueous bath having a pH ranging from about 4.5 to about 2.0; and arresting said hydrolysis.

28. A process for converting polyester containing yarns, fabrics, and garments to zero pilling polyester containing yarns, fabrics, and garments comprising the steps of:

providing a yarn, fabric, or garment comprising a polyester fiber including a polyester polymer containing a structure opener and a monomer containing a sulfonate group;

hydrolyzing said yarn, fabric, or garment in an aqueous bath having a pH ranging from about 4.5 to about 2.0 and having a temperature ranging from about 100° C. to about 150° C. for about 5 to about 120 minutes until the polyester polymer's intrinsic viscosity reaches the zero pilling polyester range; and arresting said hydrolysis.

29. A process for producing zero pilling polyester filament, staple, yarn, and fabrics comprising the step of:

providing a polyester polymer containing a structure opener and a monomer containing a sulfonate group;

forming said polymer into fibers;

hydrolyzing said fibers until the polyester polymer's intrinsic viscosity reaches the zero pilling polyester range by providing an aqueous bath having a pH ranging from about 4.5 to about 2.0; and arresting said hydrolysis.

30. A process for converting polyester containing yarns, fabrics, and garments to zero pilling polyester containing yarns, fabrics, and garments comprising the steps of:

providing a yarn, fabric, or garment comprising a polyester fiber including a polyester polymer containing a structure opener and a monomer containing a sulfonate group;

hydrolyzing said yarn, fabric, or garment until the polyester polymer's intrinsic viscosity reaches the zero pilling polyester range by providing an aqueous bath having a pH ranging from about 4.5 to about 2.0; and arresting said hydrolysis by raising the pH above about 4.5.

31. A process for converting polyester containing yarns, fabrics, and garments to a zero pilling polyester containing yarns, fabrics, and garments comprising the steps of:

providing a yarn, fabric, or garment comprising a polyester fiber including a polyester polymer containing a structure opener and a monomer containing a sulfonate group;

hydrolyzing said yarn, garment, or fabric in an aqueous bath having a pH ranging from about 4.5 to 2.0 and having a temperature ranging from about 100° C. to about 150° C. for about 5 to about 120 minutes until the polyester polymer's intrinsic viscosity reaches the zero pilling polyester range; and arresting said hydrolysis by raising the pH to above about 4.5.

* * * * *